United States Patent [19]

Gould

[11] Patent Number: 4,541,127

[45] Date of Patent: Sep. 17, 1985

[54] BASEBALL PROTECTION DEVICE

[75] Inventor: Russell J. Gould, Medford, Oreg.

[73] Assignee: Diamond Guard, Inc., Medford, Oreg.

[21] Appl. No.: 533,426

[22] Filed: Sep. 19, 1983

[51] Int. Cl.[4] ..... A41D 13/10

[52] U.S. Cl. ..... 2/19; 2/161 A

[58] Field of Search ..... 2/16, 19, 160, 161 A, 2/170, 161 R

[56] References Cited

U.S. PATENT DOCUMENTS

| | | | |
|---|---|---|---|
| Re. 31,538 | 3/1984 | Antonious | 2/161 A |
| 811,389 | 1/1906 | Ferry | 2/19 |
| 889,397 | 6/1908 | O'Shaughnessy | 2/161 A |
| 1,130,895 | 3/1915 | Gamble . | |
| 1,602,027 | 10/1926 | Kennedy | 2/19 |
| 2,832,074 | 4/1958 | Wheeler | 2/16 |
| 3,994,024 | 11/1976 | Bates | 2/19 |
| 4,034,979 | 7/1977 | Wester | 2/161 A |
| 4,120,052 | 10/1978 | Butler | 2/16 |

OTHER PUBLICATIONS

"Pirates' Pena Tries Out Experimental Mitt", published in a Spring 1983 issue of the *Oregonian*.

*Primary Examiner*—Henry S. Jaudon
*Assistant Examiner*—T. Graveline
*Attorney, Agent, or Firm*—Klarquist, Sparkman, Campbell, Leigh & Whinston

[57] ABSTRACT

A baseball protection device for attachment to a baseball glove includes a multi-layered shielding portion for protecting the wrist and lower forearm of one who wears the glove. It also includes a stretchable fabric sewn to outermost side edges of the shielding portion such that the shielding portion and fabric together encircle the wrist and forearm. The shielding portion is formed from two separate but attached sections sewn together along a seam extending lengthwise of the wrist and forearm. Each section has a pad of pliable, shock-absorbent material and a sheet of hard, semi-rigid material superimposed on top of the pad. The pad and sheet are encased in a durable material. The device is provided with a plurality of eyelets at a forward end thereof for detachably fastening the device to a heel portion of the glove using the existing glove lacing.

12 Claims, 6 Drawing Figures

BASEBALL PROTECTION DEVICE

BACKGROUND OF THE INVENTION

This invention relates generally to baseball protection devices and more particularly to protection devices attachable to a baseball or softball glove.

Catchers and infielders ("players"), particularly first basemen, routinely take hard blows on the medial part of the wrist and lower forearm of their fielding arms while attempting to field hard-hit or thrown baseballs. Typically, the baseball skips on the ground or takes a bad hop, surprising the player and resulting in a severe, painful bruise or welt on the vulnerable medial part of the player's wrist or lower forearm. On rare occasions, a fracture of the wrist or lower forearm may even result.

Several attempts have been made to protect this part of the player's arm, but without much success. For example, Bates U.S. Pat. No. 3,994,024 shows a padded protector flap which laces to the heel of a catcher's mitt. The flap is a nuisance to the catcher because the laced connection between the flap and mitt allows the flap to swing freely. Furthermore, the flap is free to flop away from the catcher's wrist to a position where the wrist is totally unprotected and, possibly, to a position where the glove pocket is obstructed for fielding the baseball. Moreover, because the flap consists of a thin, single padded layer covered in leather, it provides only limited protection for the catcher's wrist, even when it does rest flush against the wrist.

Kennedy U.S. Pat. No. 1,602,027 also shows a wrist protection device which laces to a catcher's mitt. The device includes a pair of inflatable tubes shaped like an open-ended bracelet partially to encircle the catcher's wrist. Aside from the leakage problem often associated with pneumatic devices of this type, this device does not fit wrists of all sizes. Chances are that the device either will be uncomfortably tight on the catcher's wrist or so loose as to be a nuisance, unless, of course, the device is tailor-made for each particular catcher's wrist.

A limited amount of wrist protection is also afforded by the wrist support shown in Ferry U.S. Pat. No. 811,389. This device is little more than a leather glove without fingers. It is designed to support the wrist of a catcher wearing a catcher's mitt, as well as to help hold the mitt on the catcher's hand. It is not a protection device, but it does have a partially wrist-encircling portion which provides *nominal* protection for the wrist.

Other protection devices of limited, if any, utility as a baseball protection device are shown in Gamble U.S. Pat. No. 1,131,895 and Wheeler U.S. Pat. No. 2,832,074. Gamble shows a hockey glove with a wrist-protecting extension that is much too heavy and bulky for use by a catcher or infielder who must possess exceptionally quick hands and reflexes to field a hard-hit or thrown baseball. Moreover, the extension is permanently sewn to the remainder of the glove, a feature which is highly impractical for a baseball glove that can be used by a player, such as an outfielder, not requiring such a device.

Wheeler shows a forearm shield for use by persons engaged in handling chemicals and abrasives. This shield is not designed to protect against blows and has no means whatsoever for connecting the same to a glove of any type.

Accordingly, there is a need for a baseball protection device that is light and flexible enough comfortably to fit wrists of all sizes and permit unrestrained movement of the player's wrist and hand, and yet strong enough to provide substantial protection for the player's wrist and lower forearm.

It is therefore one object of the invention to provide a baseball protection device that is light and flexible, and yet provides substantial unrestraining protection for the player's wrist and lower forearm.

Another object of the invention is to provide a protection device, as aforesaid, that is comfortable to wear and yet fits wrists of all sizes.

Yet another object of the invention is to provide a device, as aforesaid, that is easily attached to and detached from the baseball glove, including both catchers' mitts and fielders' gloves.

Still another object of the invention is to provide a device, as aforesaid, that does not flop loosely on the player's wrist so as to be a nuisance or, possibly, to obstruct the glove pocket.

SUMMARY OF THE INVENTION

In accordance with the foregoing objects, the present invention comprises a baseball protection device having shielding means for protecting a medial part of the wrist and lower forearm of one who wears the glove and wrist-securing means for securing the shielding means against the wrist and lower forearm. The shielding means and wrist-securing means together encircle the wrist and lower forearm. Attaching means are provided detachably to fasten the device to a baseball glove or mitt. The shielding means comprises a pad of pliable, shock-absorbent material for positioning adjacent the wrist or forearm and a sheet of hard, semi-rigid material outwardly of the absorbent material. The wrist-securing means is made of a stretchable material that is sewn to the shielding means to enable the device to fit wrists of all sizes.

DETAILED DESCRIPTION OF A PREFERRED EMBODIMENT

Figure 1:
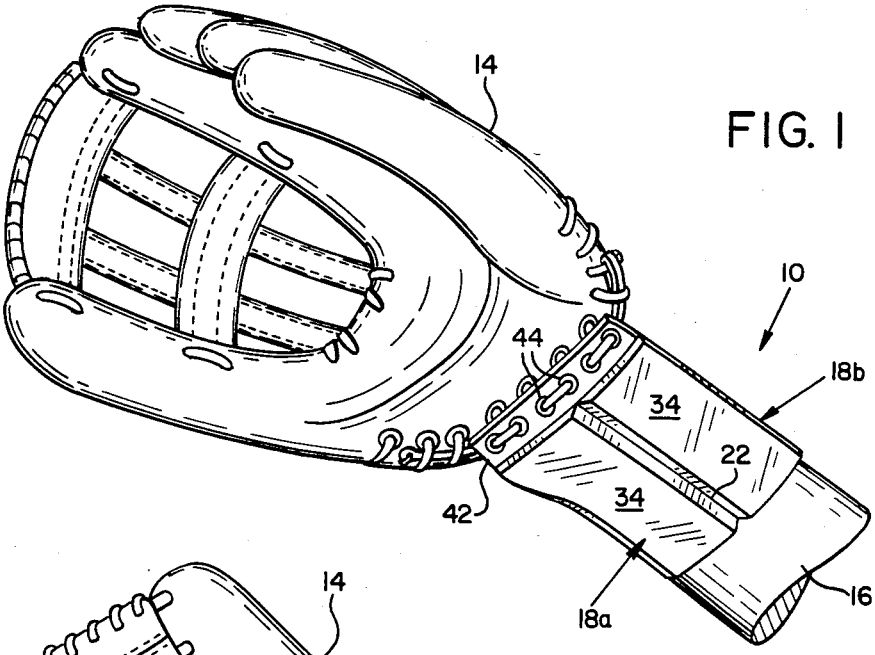
FIG. 1 is an elevational view showing a baseball protection device in accordance with the present invention attached to a baseball glove.
Figure 2:
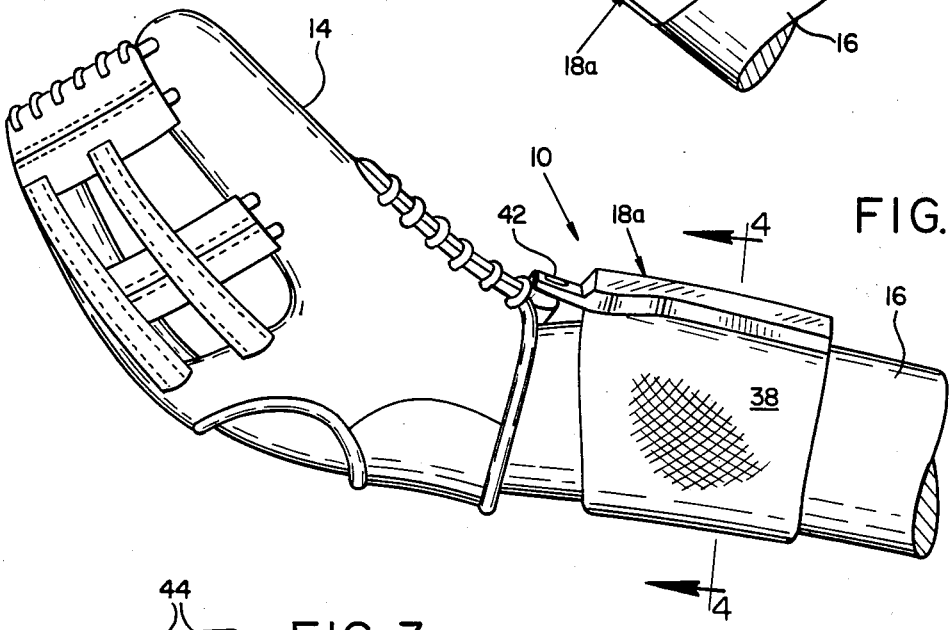
FIG. 2 is a side elevational view of the device of FIG. 1.

The present invention, designated by the reference numeral 10, detachably fastens to the heel portion of a baseball or softball glove 14. It includes a multilayered shielding means that protects or shields a medial part 16 of the wrist and lower forearm of one who wears the glove. The shielding means is secured comfortably against the wrist and lower forearm by a wrist-securing means, such that the wrist-securing means and shielding means together encircle the wrist. The device is attached to the glove by attaching means.

The shielding means is formed from two separate but attached sections 18*a*, 18*b* sewn together along a seam 22 extending lengthwise of the wrist and forearm. Seam 22 provides a loose joint between the sections, giving the shielding means added circumferential flexibility to permit unrestrained movement of the player's wrist and forearm.

Figure 4:
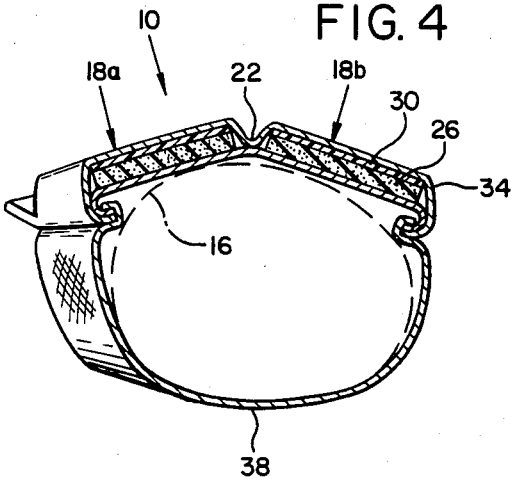
FIG. 4 is a vertical sectional view taken along line 4—4 of FIG. 2.

Each section 18*a*, 18*b* includes a pad 26 (FIG. 4) of pliable, shock-absorbent material, such as sponge rubber. Superimposed on top of pad 26 is a sheet 30 of hard, semi-rigid material, such as acetate plastic, polyurethane, or vinyl. The pad and sheet together are encased in a durable material 34, such as leather or rawhide. The pad is positioned to lie next to the wrist to absorb shock, whereas the sheet is positioned on top of the pad to receive the direct impact of the baseball. In this way, substantial protection is provided for the player's wrist and lower forearm against hard-hit or thrown baseballs.

It has been found that a pad of sponge rubber and a sheet of 30–45 gauge acetate plastic together encased in rawhide works well.

The wrist-securing means includes a stretchable fabric 38 sewn to the outermost side edge of sections 18*a*, 18*b*. Fabric 38 stretches to enable the device to fit wrists and forearms of virtually any size. It has been found that a blended fabric of elastic and perspiration-absorbing terry cloth enables the device to fit comfortably, yet snugly on the wrist and lower forearm of the player.

Figure 3:
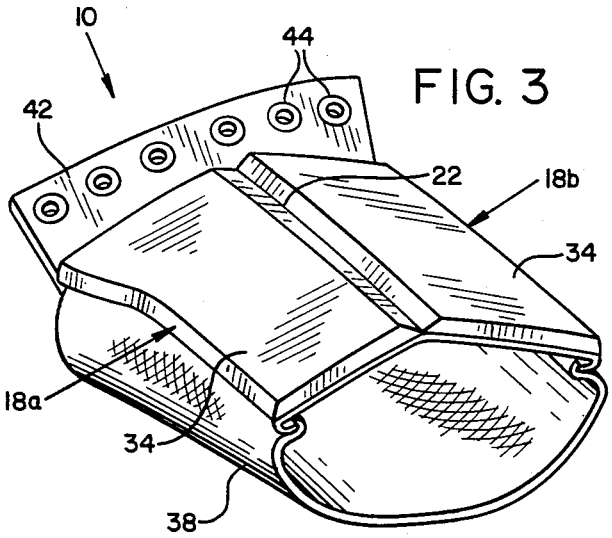
FIG. 3 is a perspective view of the device, as detached from the baseball glove.

The attaching means includes a forward flap 42 (FIG. 3) at the forward end of sections 18*a*, 18*b* and eyelets 44 set in such flap. Eyelets 44 are used to lace the device to the heel portion of the glove using the existing glove lacing. The device can be detached from the glove simply by unlacing it.

Alternatively, the device can be detachably fastened to the glove in one of several other ways. For example, a thumb loop attached to the forward end of the device can be looped over the thumb of the baseball glove. Also, referring to FIG. 5, the attaching means can include a first Velcro fastening strip 50, or strip of other self-fastening material, attached to flap 42, in place of eyelets 44, and a second mating Velcro fastening strip 50 attached to the heel of the glove to engage the first strip. Another possibility is to provide a Velcro fastening strip or similar fastener on flap 42 for attachment to a batting glove worn inside the baseball glove and comprised in part of Velcro material or the like.

Those skilled in the art will appreciate that some deviation from the above arrangement will still result in a satisfactory protection device. For example, the wrist-securing means can comprise one or more elastic straps sewn to the outermost side edges of sections 18*a*, 18*b*, instead of stretchable fabric 38. Alternatively, referring to FIG. 5, the wrist-securing means can comprise one or more loops 52 attached to one outermost edge of sections 18*a*, 18*b* and Velcro fastening strips 54 or other similar self-fasteners attached to the other outermost edge of the sections. The straps are laced through the loops and adjustably adhered back upon itself fittingly to engage wrists of all sizes. Additionally, the shielding means can be formed of more than two separate sections to give the protection device even greater flexibility.

Figure 5:
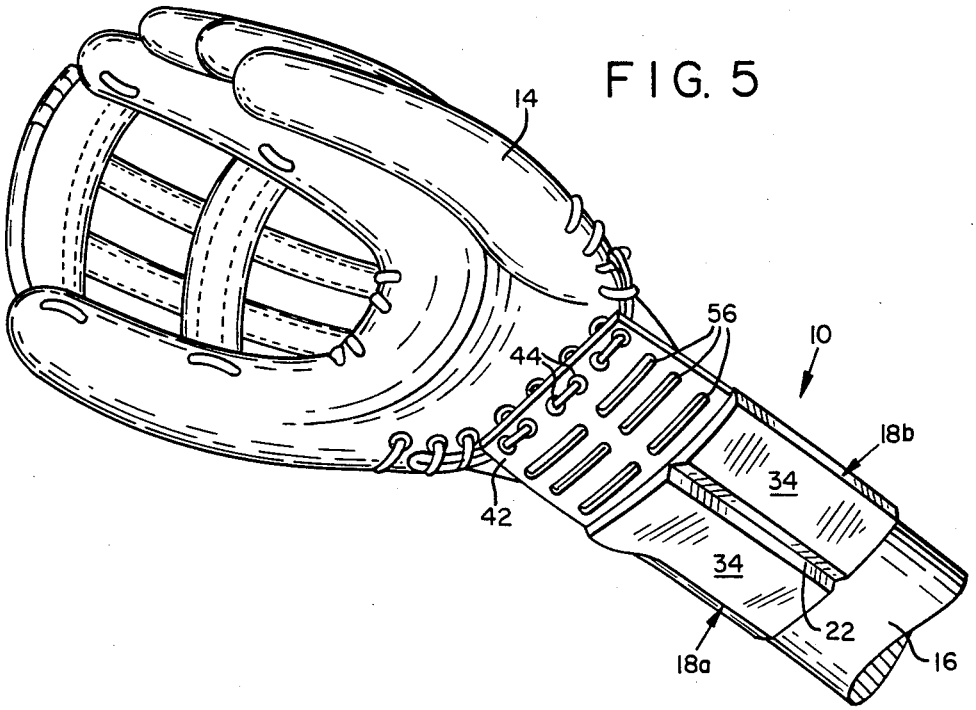
FIG. 5 is an elevational view of a second embodiment of the present invention.
Figure 6:
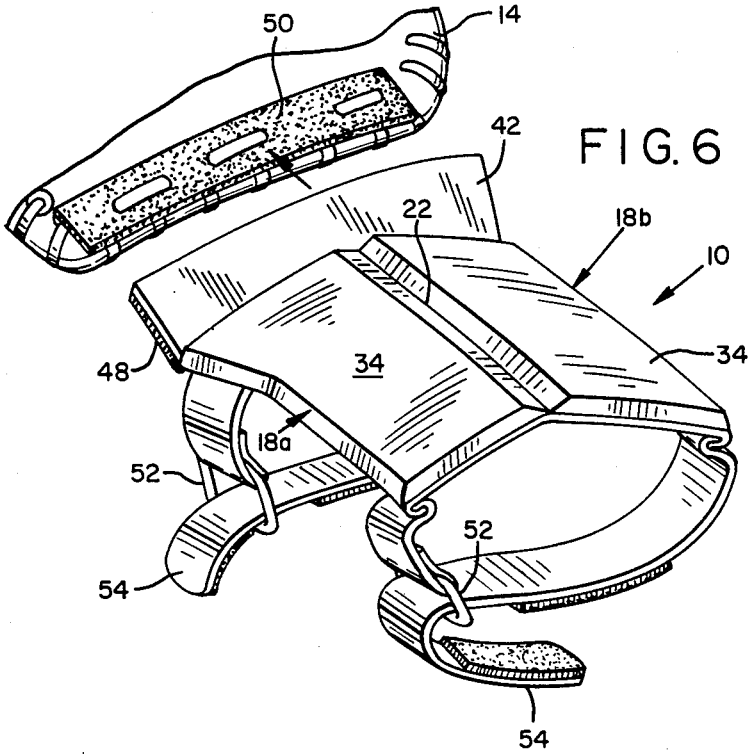
FIG. 6 is a perspective view of a third embodiment of the present invention with the baseball glove detached.

For a catcher or infielder who does not insert his hand completely into the glove or mitt, leaving part of the palm exposed, the device can be provided with an extended flap 42 having padded ribs 56 sewn therein, as shown in FIG. 5. In this way, the player's exposed palm, as well as the entire vulnerable area of his wrist and lower forearm, is protected.

The described device is light and adapted comfortably to fit wrists and forearms of all sizes. Yet, it provides substantial protection for the wrist and lower forearm of the fielder, without restraining the movement of the fielder's wrist and forearm or obstructing the glove pocket.

Having illustrated and described the principles of my invention by what is presently a preferred embodiment and several suggested alternatives, it should be apparent to those persons skilled in the art that such invention may be modified in arrangement and detail without departing from such principles.

I claim as my invention all such modifications as come within the true spirit and scope of the invention as defined by the following claims:

1. A protection device for attachment to a baseball or softball glove comprising:

shielding means for protecting a medial part of the wrist and lower forearm of one who wears the glove;

wrist-securing means for securing said shielding means against the wrist and lower forearm such that said shielding means and wrist-securing means together completely encircle the wrist and lower forearm; and attaching means for detachably fastening the device to the glove;

said shielding means including a pad of pliable, shock-absorbent material and a sheet of hard, semi-rigid material, said pad of pliable material comprising a body of solid, compressible material, and further including encasing means encasing said shock-absorbent material and semi-rigid material in overlying proximate relationship;

said shielding means including a plurality of separate but attached sections separated by a seam between said sections to give said shielding means added flexibility.

2. A device according to claim 1 wherein said wrist-securing means includes a stretchable material sewn to said shielding means such that the device fittingly engages wrists of all sizes.

3. A device according to claim 1 wherein each said seam extends lengthwise of the wrist and forearm to give said shielding means added circumferential flexibility.

4. A device according to claim 1 wherein said wrist-securing means includes loop means fastened to a first side edge of said shielding means and at least one strip of self-fastening material secured to an opposite second side edge of said shielding means, whereby said strip can be laced through said loop means across the wrist and adjustably fastened back upon itself fittingly to engage wrists of all sizes.

5. A device according to claim 1 wherein said attaching means includes lacing means for lacing a forward end of said shielding means to a heel portion of said baseball glove.

6. A device according to claim 1 wherein said attaching means includes a first strip of self-fastening material secured to an extended flap at one end of said shielding means and a second mating strip of self-fastening material secured to a heel portion of said baseball glove for engagement with said first strip.

7. A device according to claim 1 wherein said encasing means comprises leather.

8. A device according to claim 7 wherein said pad and sheet are superimposed on top of one another with said pad positioned closest to the wrist.

9. A baseball protection device for attachment to a baseball or softball glove comprising:

shielding means having first and second portions for protecting a medial part of the wrist and lower forearm of one who wears the glove;

wrist-securing means for securing said first portion against the wrist and lower forearm such that said first portion and wrist-securing means completely encircle the wrist and lower forearm; and attaching means including said second portion for detachably fastening the device to the glove;

said second portion including an extended flap having padded ribs sewn therein and lacing means for lacing said flap to a heel portion of said glove.

10. A device according to claim 9 wherein said shielding means includes encasing means encasing shock-absorbent material and semi-rigid material is an overlying, adjacent relationship.

11. A device according to claim 9 wherein said shielding means includes a plurality of separate but attached sections with a seam between adjacent sections extending lengthwise of the wrist and forearm to give said shielding means added circumferential flexibility, each said section having a pad of shock-absorbent material and a sheet of hard, semi-rigid material together encased in a durable fabric.

12. A baseball protection device for attachment to a baseball or softball glove comprising:

shielding means for protecting a medial part of the wrist and lower forearm of one who wears the glove;

wrist-securing means for securing said shielding means against the wrist and lower forearm, and including a stretchable material sewn to said shielding means such that said shielding means and wrist-securing means together encircle the wrist fittingly to engage wrists of all sizes; and attaching means for detachably fastening the device to the glove;

said shielding means including two separate but attached sections with a seam therebetween extending lengthwise of the wrist and forearm to give the shielding means added circumferential flexibility;

each said section including a pad of pliable, shock-absorbent material, sheet of hard, semi-rigid material superimposed on top of said pad and durable fabric encasing said pad and sheet;

said attaching means including lacing means for lacing a forward end of said shielding means to a heel portion of the glove.

* * * * *